US006739291B2

(12) United States Patent
Kawakubo et al.

(10) Patent No.: US 6,739,291 B2
(45) Date of Patent: May 25, 2004

(54) PISTON COOLING DEVICE FOR MULTICYLINDER ENGINE

(75) Inventors: Hiroyuki Kawakubo, Saitama (JP); Tetsuya Nakayasu, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 85 days.

(21) Appl. No.: 10/226,169

(22) Filed: Aug. 23, 2002

(65) Prior Publication Data

US 2003/0041815 A1 Mar. 6, 2003

(30) Foreign Application Priority Data

Aug. 31, 2001 (JP) ..... 2001-264491

(51) Int. Cl.[7] ..... F01P 1/04
(52) U.S. Cl. ..... 123/41.35; 123/196 R
(58) Field of Search ..... 123/41.35, 196 R

(56) References Cited

U.S. PATENT DOCUMENTS 4,010,718 A 3/1977 Stewart
5,533,472 A 7/1996 Sands et al.
5,896,656 A 4/1999 Laws
6,205,971 B1 3/2001 Inumaru et al.

FOREIGN PATENT DOCUMENTS

DE 196 15 234 C1 7/1997
JP 10-169438 A 6/1998

*Primary Examiner*—Noah P. Kamen
(74) *Attorney, Agent, or Firm*—Birch, Stewart, Kolasch & Birch, LLP

(57) ABSTRACT

A piston cooling structure for a multicylinder engine having oil jets for ejecting oil toward pistons. The oil jets are mounted in each of a plurality of journal walls except one journal wall. The piston cooling structure is able to supply oil to a cylinder head in a position closer to a central region along the axis of the crankshaft while avoiding a complex oil passage shape. An oil passage for guiding oil to a cylinder head is defined in the one of the journal walls without an oil jet, and this one journal wall is disposed between a pair of adjacent cylinder bores. Oil jets are mounted in each of the other journal walls. A crankshaft of the engine is rotatably supported by the journal walls.

19 Claims, 4 Drawing Sheets

PISTON COOLING DEVICE FOR MULTICYLINDER ENGINE

CROSS-REFERENCE TO RELATED APPLICATION

The present application claims priority under 35 U.S.C. §119 to Japanese Patent Application No. 2001-264491, filed Aug. 31, 2001, the entire contents of which are hereby incorporated by reference.

BACKGROUND OF THE INVENTION

1. Field of the Invention

The present invention relates to a piston cooling device for a multicylinder engine, and more particularly to a piston cooling device for a multicylinder engine having a crankshaft rotatably supported by a plurality of journal walls disposed on both sides of a plurality of cylinder bores arrayed in the axial direction of the crankshaft. Oil jets are mounted in each of the plurality of journal walls except one journal wall, and serve the purpose of ejecting oil toward pistons which slide within the cylinder bores.

2. Description of Background Art

Heretofore, a piston cooling device of the type described above has been known, for example, from Japanese Patent Laid-open No. Hei 10-169438.

In the conventional piston cooling device, oil jets are mounted in journal walls between cylinder bores and one of journal walls at opposite ends in the axial direction of a crankshaft.

An oil passage for guiding oil to a cylinder head is defined in one of the journal walls. With the oil jets thus mounted in the journal walls in the conventional piston cooling device, in order to avoid a reduction in the rigidity of a journal wall which would have both the oil passage and the oil jet, the oil passage has to be defined in the other of the journal walls at opposite ends in the axial direction of the crankshaft. The oil passage which extends simply vertically supplies oil to the cylinder head on either side along the axis of the crankshaft. For distributing oil uniformly to the cylinders in the cylinder head, however, it is desirable to supply oil to the cylinder head at a position closer to a central region along the axis of the crankshaft. In the conventional piston cooling device, the oil passage required to adequately supply oil is complex in shape.

The present invention has been made in view of the above problems. It is an object of the present invention to provide a piston cooling device for a multicylinder engine which is capable of supplying oil to a cylinder head at a position closer to a central region along the axis of a crankshaft, while avoiding a complex oil passage shape.

SUMMARY AND OBJECTS OF THE INVENTION

To achieve the above object, according to a first aspect of the present invention, a piston cooling device is provided for a multicylinder engine having a crankshaft rotatably supported by a plurality of journal walls disposed on both sides of a plurality of cylinder bores arrayed in the axial direction of the crankshaft. Oil jets are mounted in each of the journal walls except one journal wall for the purpose of ejecting oil toward pistons which slide within the cylinder bores. An oil passage for guiding oil to a cylinder head is defined in one of the journal walls which are positioned between a pair adjacent cylinder bores, and said oil jets are mounted respectively in each of the other journal walls.

With this arrangement, since the oil passage is defined in one of the journal walls which is positioned at a pair of adjacent cylinder bores, and no oil jet is mounted in that one of the journal wall, oil can be supplied to the cylinder head at a position closer to a central region along the axis of the crankshaft, while maintaining the desired rigidity of the journal wall. The oil passage so disposed has a simple vertically extending shape.

In accordance with a second aspect of the present invention, the journal wall which has said oil passage defined therein is integrally joined to a partition wall disposed between said crankshaft and a transmission shaft which serves as part of a transmission and extends parallel to the crankshaft. Further, the transmission shaft is rotatably supported by a support shaft integrally joined to said partition wall at a position adjacent to the journal wall which has said oil passage defined therein.

With this arrangement, the rigidity of the partition wall and the rigidity of the joint portion of the support wall to the partition wall are kept at a high level. Specifically, since the oil passage is not open at an outer surface of the journal wall, any effect which the oil passage has on the rigidity of the journal wall is small. Also. Since this journal wall does not have oil jet, its rigidity is kept relatively high. Since this journal wall is integrally joined to the partition wall, the rigidity of the partition wall is kept at a high level also. Furthermore, inasmuch as the support wall is integrally joined to the partition wall at a position adjacent to the journal wall whose rigidity is relatively high, the joint portion between the partition wall and the support wall has its rigidity kept at a high level also.

In accordance with a third aspect of the present invention, a clutch is mounted on one end of the transmission shaft which extends through said support wall. Further, a drive gear disposed on said crankshaft is held in mesh with a driven gear relatively rotatably mounted on said transmission shaft for inputting power to the clutch. With this arrangement, regardless of the structure in which the clutch is supported on the support shaft by the transmission shaft, the structure in which a radial load tends to act on the transmission shaft due to the meshing engagement between the drive gears and the driven gears, the support wall, and the partition wall are made lightweight. As such, they can effectively support the transmission shaft without the need for thickening the support wall and the partition wall. This is based on the advantage that the rigidity of the support wall and the rigidity of the joint portion between the support wall and the partition wall are kept at a high level.

In accordance with a fourth aspect of the present invention, the drive gear is disposed on one of a plurality of crank webs of the crankshaft, which is positioned at an axial end of the crankshaft. Further, the oil jet is mounted in the journal wall which is disposed outwardly of said drive gear and has an oil ejection axis (L) displaced from said drive gear. With this arrangement, the drive gear does not obstruct the cooling of the pistons with the ejection of oil from the oil jets, and oil ejected from the oil jets is spread to effectively lubricate the meshing portions of the drive gears and the driven gears.

In accordance with a fifth aspect of the present invention, at least one of a plurality of crank webs of the crankshaft is shaped to traverse an oil ejection axis of the oil jet corresponding to the at least one crank web when the piston corresponding to said at least one crank web is positioned in a predetermined range near the bottom dead center. In this position, the at least one crank web is kept away from the oil ejection axis when the piston corresponding to the at least one crank web is positioned out of the predetermined range. With this arrangement, when at least one piston is positioned in the predetermined range near the bottom dead center, oil ejected from the oil jet does not directly hit the piston from below, preventing the rotational friction of the engine from being increased by the ejection of oil.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment of the present invention will be described below with reference to the accompanying drawings.

Figure 1:
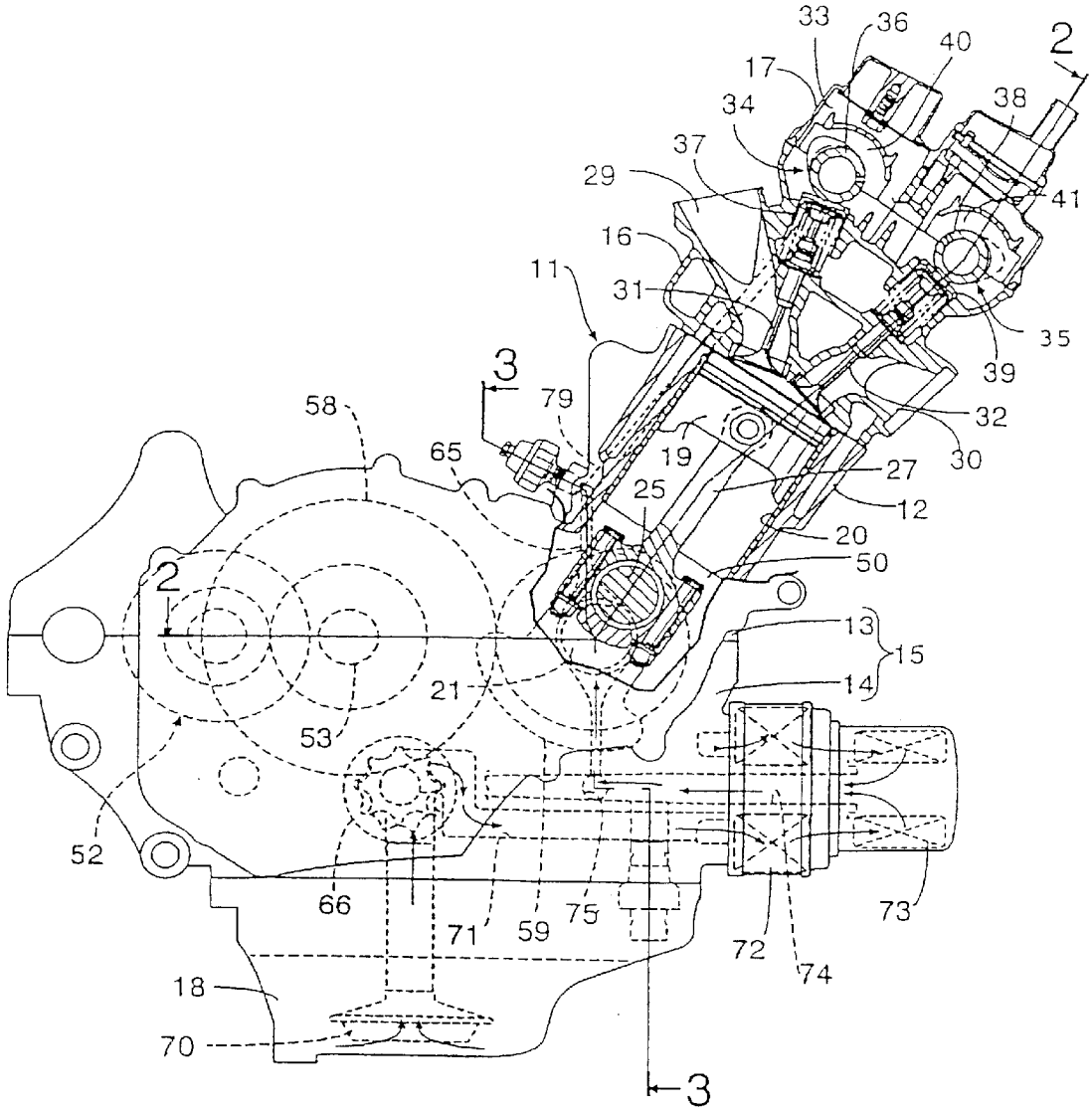
FIG. 1 is a side elevational view, partly in vertical cross section, of an engine.
Figure 2:
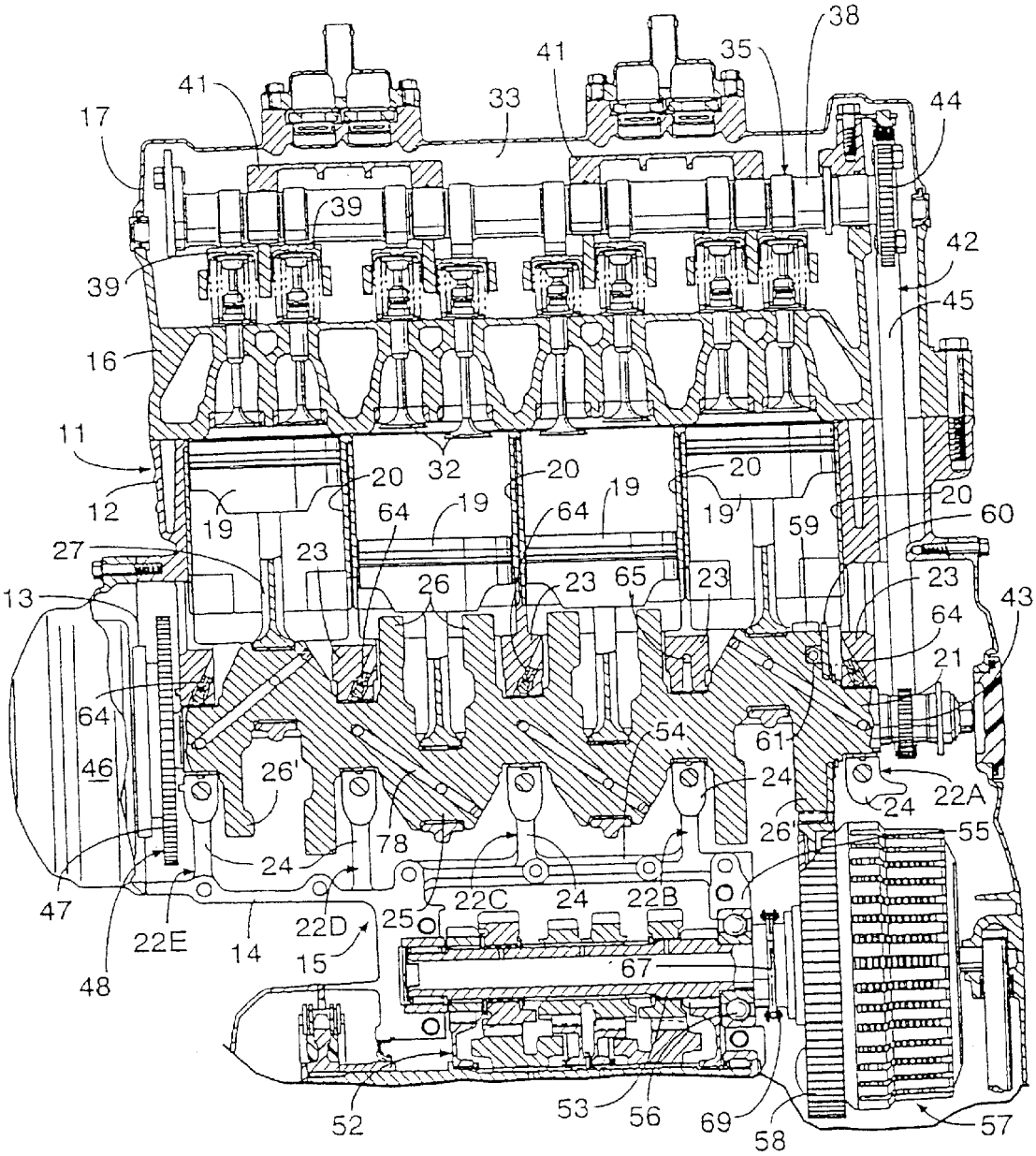
FIG. 2 is a cross-sectional view taken along line 2—2 of FIG. 1.
Figure 3:
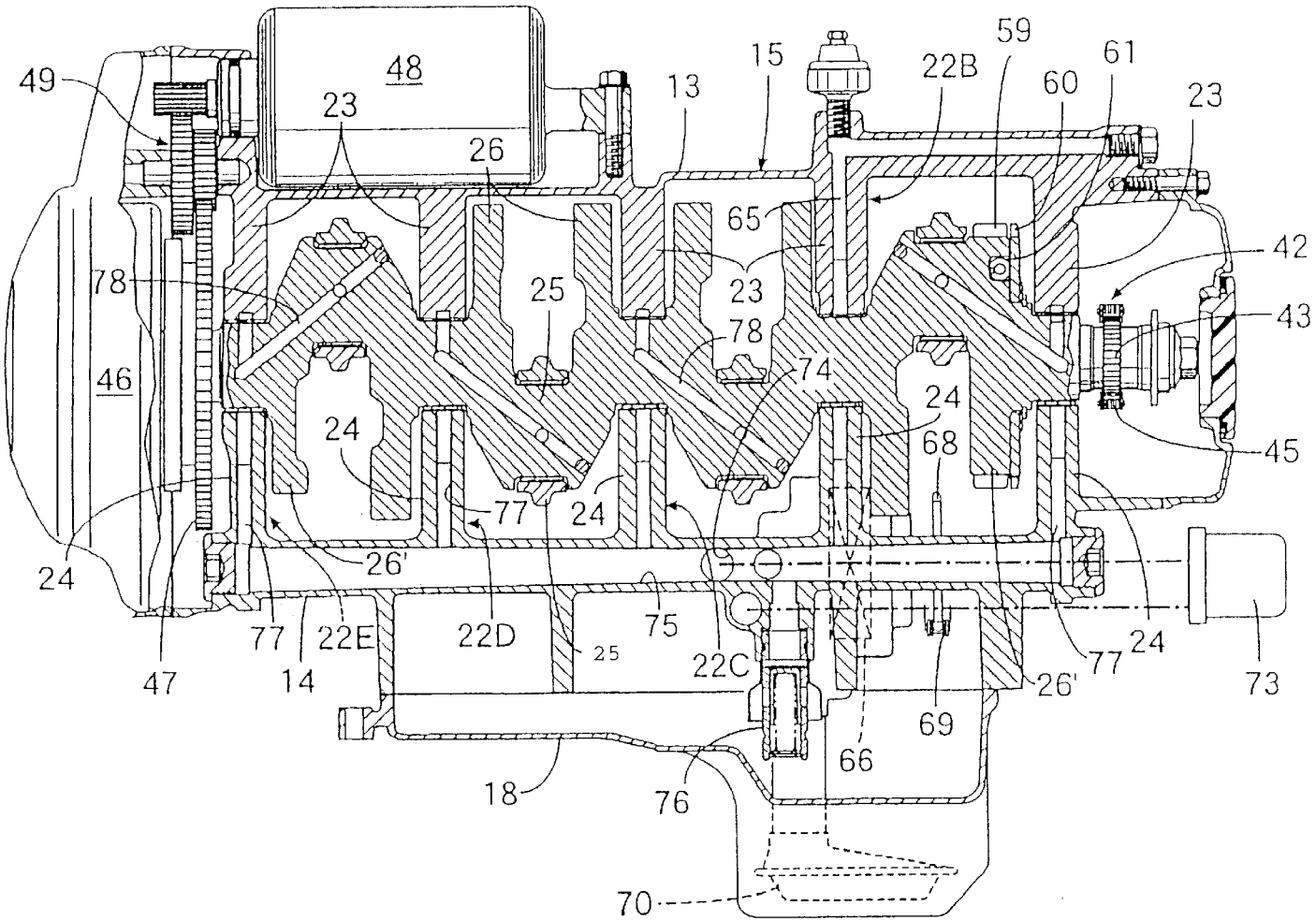
FIG. 3 is a cross-sectional view taken along line 3—3 of FIG. 1.

In FIGS. 1 through 3, an engine having multiple cylinders, e.g., four cylinders, is mounted on a motorcycle. The engine has a cylinder block 11 including a crankcase 15 having an upper crankcase 13 integral with a lower portion of a cylinder body 12. A lower crankcase 14 is fastened to a lower portion of the upper crankcase 13.

A cylinder head 16 is fastened to an upper portion of the cylinder block 11, i.e., an upper portion of the cylinder body 12. A head cover 17 is fastened to an upper portion of the cylinder head 16. An oil pan 18 is fastened to a lower portion of the crankcase 15, i.e., a lower portion of the lower crankcase 14.

The cylinder body 12 has four cylinder bores 20 in which respective pistons 19 are slidably fitted, the cylinder bores 20 being arrayed along the axis of a crankshaft 21 which interconnects the pistons 19.

The crankshaft 21 is rotatably supported by a plurality of, e.g., five, journal walls 22A, 22B, 22C, 22D, and 22E of the crankcase 15. The journal walls 22B, 22C, and 22D are disposed between the cylinder bores 20.

The journal walls 22A through 22E include upper walls 23 integral with the upper crankcase 13 of the cylinder block 11 and support an upper half of the crankshaft 21. Lower walls 24 support a lower half of the crankshaft 21 and are fastened to the upper walls 23, the lower walls 24 being mounted in the lower crankcase 14.

Crank pins 25 and pairs of crank webs 26 joined to opposite ends of the crank pins 25 are disposed on the portion of the crankshaft 21, which corresponds to inner two of the cylinder bores 20 along the axis of the crankshaft 21. Larger ends of connecting rods 27, connected to the pistons 19 which slidably fit into the inner two cylinder bores 20, are coupled to the crank pins 25.

Crank pins 25 and crank webs 26, which are identical in shape to the above crank webs and joined to inner ends of the crank pins 25, and crank webs 26' extending a shorter distance than the above crank webs 26 from the axis of the crankshaft 21 and joined to outer ends of the crank pins 25, are disposed on the portion of the crankshaft 21 which corresponds to outer two of the cylinder bores 20 along the axis of the crankshaft 21. Larger ends of connecting rods 27, connected to the pistons 19 which are slidably fit into the outer two cylinder bores 20, are coupled to the crank pins 25.

Combustion chambers 28, which are faced by the top ends of the pistons 19, are defined between the cylinder body 12 and the cylinder head 16 of the cylinder block 11. The cylinder head 16 has intake ports 29 defined therein, corresponding to the respective combustion chambers 28. The intake ports 29 open at one side of the cylinder head 16. The cylinder head 16 also has exhaust ports 30 defined therein, corresponding to the respective combustion chambers 28. The exhaust ports 30 open at the other side of the cylinder head 16.

Intake air supplied from the intake ports 29 to the combustion chambers 28 is controlled by pairs of intake valves 31 provided respectively in the combustion chambers 28. Exhaust gases discharged from the combustion chambers 28 to the exhaust ports 30 are controlled by pairs of exhaust valves 32 provided respectively in the combustion chambers 28. The intake valves 31 and the exhaust valves 32 are openably and closably mounted in the cylinder head 16.

A valve operating chamber 33 is defined between the cylinder head 16 and the head cover 17, and houses therein an intake valve operating device 34 for opening and closing the intake valves 31. Also housed therein is an exhaust valve operating device 35 for opening and closing the exhaust valves 32.

The intake valve operating device 34 includes a camshaft 36, extending parallel to the crankshaft 21, and a plurality of valve lifters 37 slidably supported in the cylinder head 16 and interposed between the camshaft 36 and the respective intake valves 31. The intake valve operating device 34 is arranged such that the paired intake valves 31 corresponding to each of the combustion chambers 28 are lifted different distances when they are opened.

The exhaust valve operating device 35 includes a camshaft 38 extending parallel to the crankshaft 21 and a plurality of valve lifters 39 slidably supported in the cylinder head 16 and interposed between the cam shaft 38 and the respective exhaust valves 32. The exhaust valve operating device 35 is arranged such that the paired exhaust valves 32 corresponding to each of the combustion chambers 28 are lifted different distances when they are opened.

The camshaft 36 of the intake valve operating device 34 is rotatably supported by the cylinder head 16 and a plurality of holders 40 fastened to the cylinder head 16. The camshaft 38 of the exhaust valve operating device 35 is rotatably supported by the cylinder head 16 and a plurality of holders 41 fastened to the cylinder head 16. Rotational power from the crankshaft 21 is transmitted to the camshafts 36 and 38 by a timing transmission means 42.

The timing transmission means 42 includes a drive sprocket 43 fixed to an end of the crankshaft 21, a driven sprocket (not shown) mounted on an end of the camshaft 36 of the intake valve operating device 34, a driven sprocket 44 fixedly mounted on an end of the camshaft 38 of the exhaust valve operating device 35, and an endless chain 45 trained around the sprockets 43 and 44. Rotational power from the crankshaft 21 is reduced in speed ½ by the timing transmission means 42, and is transmitted to the camshafts 36 and 38 thereby.

An electric generator 46 is coupled to the other end of the crankshaft 21. A driven gear 47 disposed closely to and axially inwardly of the electric generator 46 is fixed to the crankshaft 21. Rotational power from a starter motor 48 supported on a side of the crankcase 15 is transmitted to the crankshaft 21 by a gear train 49 including the driven gear 47.

Within the crankcase 15, there are defined a crank shaft chamber 50 housing the crankshaft 21 and a transmission chamber 51 housing a transmission 52 for transmitting power from the crankshaft 21 selectively at various speed-reduction ratios. A partition wall 54 is disposed between the crankshaft 21 and a transmission shaft 53 serving as part of the transmission 52 and extending parallel to the crankshaft 21.

The partition wall 54 is made up of walls integral with the upper crankcase 13 and the lower crankcase 14, which walls are fastened together when the upper crankcase 13 and the lower crankcase 14 are fastened into the crankcase 15.

Of the journal walls 22A through 22E, the journal walls 22B and 22C are joined to the partition wall 54. Since the upper walls 23 of the journal walls 22B and 22C are integral with the upper crankcase 13 and the lower walls 24 of the journal walls 22B and 22C are integral with the lower crankcase 14, the journal walls 22B and 22C are integrally joined to the partition wall 54.

The transmission shaft 53 has one end rotatably supported by a side wall of the crankcase 15. The transmission shaft 53 has a portion near the other end thereof which is rotatably supported by a ball bearing 56 on a support wall 55 which is integrally joined to the partition wall 54 at a position adjacent to the journal wall 22B.

A clutch 57 comprising a multiplate clutch is mounted on the end of the transmission shaft 53 which extends through the support wall 55. A driven gear 58 for inputting power to the clutch 57 is relatively rotatably mounted on the transmission shaft 53. Further, a drive gear 59 held in mesh with the driven gear 58 is mounted on the crankshaft 21.

The drive gear 59 is disposed on the crank web 26' positioned on one end of the crankshaft 21 along its axis, of all the crank webs 26 and 26' of the crankshaft 21.

An auxiliary gear 60 is mounted on the crankshaft 21 and held in mesh with the driven gear 58 at a position adjacent to the drive gear 59. Being so mounted, the auxiliary gear 60 is rotatable, but axially immovable, with respect to the drive gear 59. Between the auxiliary gear 60 and the drive gear 59, a spring 61 is disposed for applying spring forces in a direction to rotate the gears 59 and 60 circumferentially with respect to each other, thereby preventing noise from being produced due to the backlash in the meshing portions of the drive gears 59 and the driven gears 58 while the engine is idling.

Figure 4:
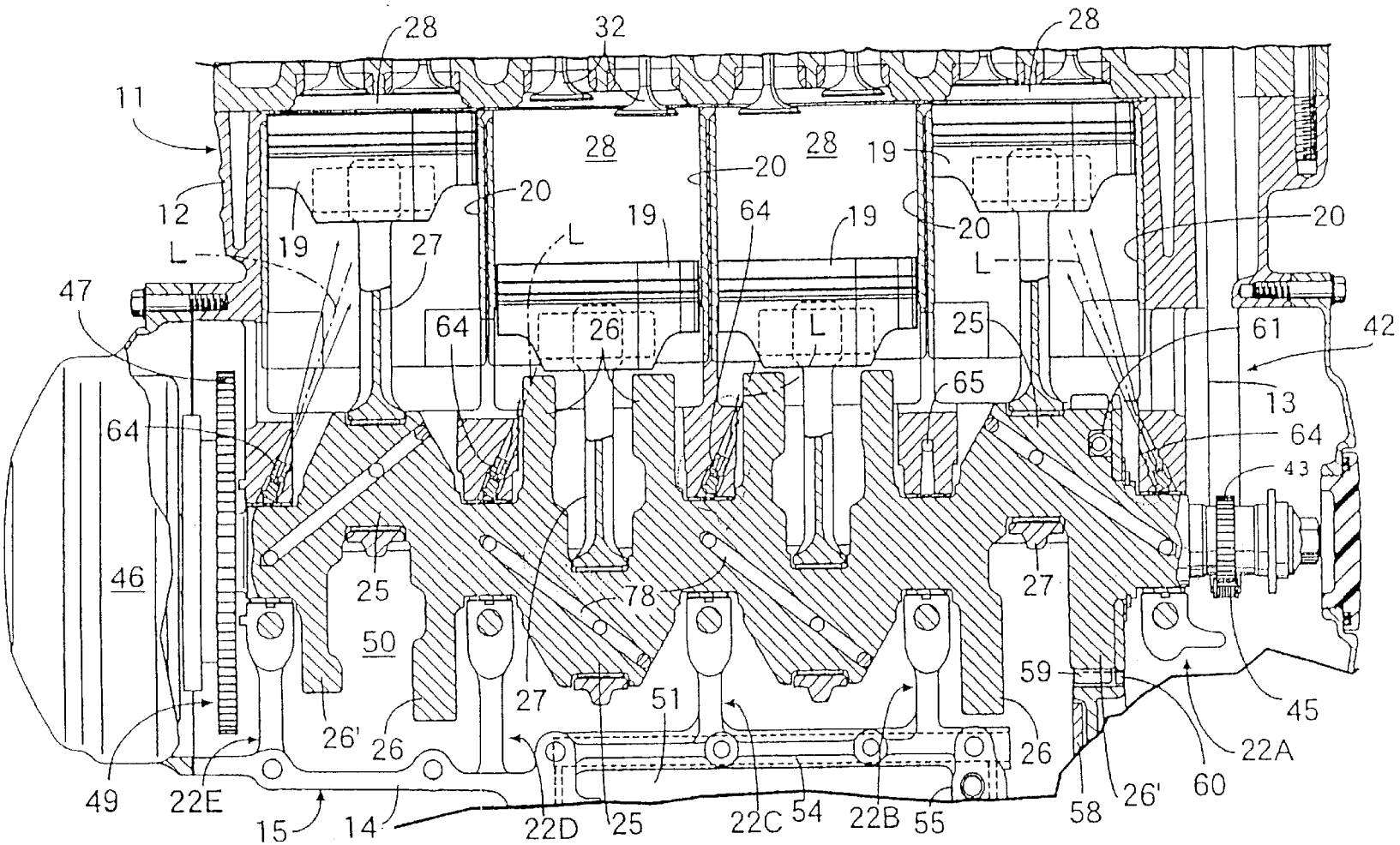
FIG. 4 is an enlarged view of a portion shown in FIG. 2.

As shown in FIG. 4, an oil passage 65 for guiding oil to the cylinder head 16 is defined in one 22B of the journal walls 22B, 22C, and 22D disposed between one pair of adjacent cylinder bores 20. Oil jets 64, for ejecting oil to the pistons 19 slidably fit into the cylinder bores 20, are mounted in each of the other journal walls 22A, 22C, 22D, and 22E. In other words, oil jets 64 are mounted in each of the journal walls except the journal wall 22B with the oil passage 65 defined therein.

The journal wall 22B with the oil passage 65 defined therein is integrally joined to the partition wall 54 between the crankshaft 21 and the transmission shaft 53. The support wall 55, by which the portion of the transmission shaft 53 close to its end is rotatably supported, is integrally joined to the partition wall 54 at a position adjacent to the journal wall 22B with the oil passage 65 defined therein.

The oil jet 64 is mounted in the journal wall 22A disposed outwardly of the drive gear 59 on the crank web 26' which is disposed on one end of the crankshaft 21 along its axis, of all the crank webs 26 and 26' of the crankshaft 21. The oil jet 64 is mounted in the journal wall 22A such that its oil ejection axis L is displaced from the drive gear 59.

At least one of the crank webs 26 and 26' of the crankshaft 21, or the crank webs 26 confronting the journal walls 22C and 22D in the present embodiment, is shaped to traverse the oil ejection axes L of the oil jets 64 corresponding to those crank webs 26 when the pistons 19 corresponding to those crank webs 26 are positioned in a predetermined range near the bottom dead center. As shown in FIG. 4, this keeps the at least one of the crank webs 26 and 26' away from the oil ejection axes L when the pistons 19 are positioned out of the predetermined range.

An oil pump 66 having an axis of rotation parallel to the transmission shaft 53 is disposed below the transmission shaft 53 in the crankcase 15. Power is transmitted to the oil pump 66 by a drive sprocket 67 rotatable with the driven gear 58, a driven sprocket 68 (see FIG. 3) mounted on the input shaft of the oil pump 66, and an endless chain 69 trained around these sprockets 67 and 68.

Oil in the oil pan 18 is drawn by the oil pump 66 through an oil strainer 70. The oil discharged from the oil pump 66 is introduced from a passage 71 in the crankcase 15 through a water-cooled oil cooler 72 and an oil filter 73 into a passage 74 in the crankcase 15. The oil then flows from the passage 74 into a main gallery 75 defined in the crankcase 15 and extending parallel to the axis of the crankshaft 21. A relief valve 76 is disposed in the crankcase 15 so as to be interposed between the passage 74 and the oil pan 18.

Passages 77 leading to the main gallery 75 are defined respectively in the journal walls 22A through 22E. Oil is supplied through the passages 77 to the portions of the crankshaft 21 which are supported by the journal walls 22A through 22E. Part of the oil is supplied to the oil jets 64 in the journal walls 22A, 22C through 22E other than the journal wall 22B with the oil passage 65 defined therein. The remainder of the oil is supplied through oil supply passages 78 defined in the crankshaft 21 to the crankpins 25 and the larger ends of the connecting rods 27.

In the journal wall 22B with the oil passage 65 defined therein, most of the oil supplied from the passage 77 to the portion of the crankshaft 21 which is supported by the journal wall 22B flows into the oil passage 65, and is supplied to the cylinder head 16 through a passage 79 (see FIG. 1) defined in the cylinder block 11 in communication with the oil passage 65.

Operation of the present embodiment will be described below. The crankshaft 21 is rotatably supported by the plurality of (five in the embodiment) journal walls 22A through 22E. The oil passage 65 for guiding oil to the cylinder head 16 is defined in one 22B of the journal walls 22B, 22C, and 22D disposed between pairs of adjacent cylinder bores 20, of all the journal walls 22A through 22E. The oil jets 64, for ejecting oil to the pistons 19 which are slidably fit into the cylinder bores 20, are mounted in each of the other journal walls 22A, 22C, 22D, and 22E. In other words, oil jets 64 are mounted in each of the journal walls except the journal wall 22B with the oil passage 65 defined therein.

Since the oil passage 65 is defined in one 22B of the journal walls 22B, 22C, and 22D, and no oil jet 64 is mounted in the journal wall 22B, oil can be supplied to the cylinder head 16 at a position closer to a central region along the axis of the crankshaft 21. At the same time, the desired rigidity of journal wall 22B can be maintained, and the oil passage 65 can be configured of a simple vertically extending shape.

The partition wall 54 is disposed in the crankcase 15 between the crankshaft 21 and the transmission shaft 53 serving as part of the transmission 52 and extending parallel to the crankshaft 21. The two journal walls 22B and 22C, which include the journal wall 22B with the oil passage 65 defined therein, are integrally joined to the partition wall 54. Further, the support wall 55, by which the transmission shaft 53 is rotatably supported, is integrally joined to the partition wall 54 at a position adjacent to the journal wall 22B. Therefore, the rigidity of the partition wall 54 and the rigidity of the joint portion of the support wall 55 to the partition wall 54 are kept at a high level.

Specifically, since the oil passage 65 is not open at an outer surface of the journal wall 22B, any effect which the oil passage 65 has on the rigidity of the journal wall 22B is small. Because the journal wall 22B whose rigidity is made relatively high by being free of an oil jet 64 that greatly affects the rigidity is integrally joined to the partition wall 54, the rigidity of the partition wall 54 is kept at a high level. Furthermore, inasmuch as the support wall 55 is integrally joined to the partition wall 54 at a position adjacent to the journal wall 22B whose rigidity is relatively high, the joint portion between the partition wall 54 and the support wall 55 has its rigidity kept at a high level.

The clutch 57 is mounted on the end of the transmission shaft 53 which extends through the support wall 55, and the drive gear 59 on the crankshaft 21 is held in mesh with the driven gear 58 which is relatively rotatably mounted on the transmission shaft 53 for inputting power to the clutch 57. Consequently, regardless of the structure in which the clutch 57 is supported on the support shaft 55 by the transmission shaft 53 and the structure in which a radial load tends to act on the transmission shaft 53 due to the meshing engagement between the drive gears 59 and driven gears 58, the support wall 55 and the partition wall 54 are made lightweight. As such, even though the support structure is light weight, it can effectively support the transmission shaft 53 without the need for thickening the support wall 55 and the partition wall 54. This is possible, because, as described above, the rigidity of the support wall 55 and the rigidity of the joint portion between the support wall 55 and the partition wall 54 are kept at a high level.

The drive gear 59 is disposed on the crank web 26' positioned on one end of the crankshaft 21 along its axis, and the oil jet 64 is mounted in the journal wall 22A disposed outwardly of the drive gear 59 and has its oil ejection axis L displaced from the drive gear 59. Therefore, the drive gear 59 does not obstruct the cooling of the pistons with the ejection of oil from the oil jets 64, and oil ejected from the oil jets 64 is spread to effectively lubricate the meshing portions of the drive gears 59 and the driven gears 58.

At least one of the crank webs 26 and 26', or the crank webs 26 confronting the journal walls 22C and 22D in the present embodiment, are shaped to traverse the oil ejection axes L of the oil jets 64 corresponding to those crank webs 26 when the pistons 19 corresponding to those crank webs 26 are positioned in a predetermined range near the bottom dead center, as shown in FIG. 4. This keeps the at least one of the crank webs 26 and 26' away from the oil ejection axes L when the pistons 19 are positioned out of the predetermined range.

Consequently, when the two pistons 19 are positioned in the predetermined range near the bottom dead center, oil ejected from the oil jets 64 does not directly hit the pistons 19 from below, preventing the rotational friction of the engine from being increased by the ejection of oil.

Although the embodiment of the present invention has been described above, the present invention is not limited to the above embodiment, but various design changes may be made without departing from the invention described in the scope of claims.

Next the primary effects of the invention are summarized.

According to a first aspect of the present invention, oil can be supplied to the cylinder head at a position closer to a central region along the axis of the crankshaft even though the oil passage is of a simple vertically extending shape.

According to a second aspect of the present invention, the rigidity of the partition wall and the rigidity of the joint portion of the support wall to the partition wall are kept at a high level.

According to a third aspect of invention, regardless of the structure in which the clutch is supported on the support shaft by the transmission shaft and the structure in which a radial load tends to act on the transmission shaft due to the meshing engagement between the drive gears and the driven gears, the support wall and the partition wall are made lightweight. As such, even though it is lightweight, the structure and can effectively support the transmission shaft without the need for thickening the support wall and the partition wall.

According to a fourth aspect of the invention, the drive gear does not obstruct the cooling of the pistons with the ejection of oil from the oil jets, and the meshing portions of the drive gears and the driven gears are lubricated effectively.

According to a fifth aspect of the aspect of the present invention, the rotational friction of the engine is prevented from being increased by the ejection of oil.

The invention being thus described, it will be obvious that the same may be varied in many ways. Such variations are not to be regarded as a departure from the spirit and scope of the invention, and all such modifications as would be obvious to one skilled in the art are intended to be included within the scope of the of the following claims.

What is claimed is:

1. A piston cooling device for a multicylinder engine, comprising:

a crankshaft;

a plurality of journal walls for supporting the crankshaft disposed on both sides of a plurality of cylinder bores arrayed in the axial direction of the crankshaft;

oil jets mounted in each of the plurality of the journal walls except one journal wall positioned between one pair of the plurality of cylinder bores, each of the oil jets for ejecting oil toward a piston slidably disposed in each of the plurality of cylinder bores; and an oil passage defined in the one journal wall not having one of the oil jets, the oil passage for guiding oil to a cylinder head.

2. A piston cooling device for a multicylinder engine according to claim 1, wherein:

the one journal wall in which said oil passage is defined is integrally joined to a partition wall disposed between said crankshaft and a transmission shaft which serves as part of a transmission and extends parallel to the crankshaft, and the transmission shaft is rotatably supported by a support wall integrally joined to said partition wall at a position adjacent to the one journal wall in which said oil passage is defined.

3. A piston cooling device for a multicylinder engine according to claim 2, wherein:

at least one crank web of a plurality of crank webs of the crankshaft is shaped to traverse an oil ejection axis of one of the oil jets corresponding to said at least one crank web when a piston, corresponding to said at least one crank web, is positioned in a predetermined range near the bottom dead center, and to keep away from said oil ejection axis when the piston corresponding to said at least one crank web is positioned out of said predetermined range.

4. A piston cooling device for a multicylinder engine according to claim 2, wherein the oil passage is positioned vertically within the one journal wall and does not open at an outer surface of the one journal wall, thus maintaining rigidity of the one journal wall and the partition wall.

5. A piston cooling device for a multicylinder engine according to claim 2, further comprising:

a clutch mounted on one end of the transmission shaft which extends through said support wall; and a drive gear disposed on said crankshaft held in mesh with a driven gear relatively rotatably mounted on said transmission shaft for inputting power to the clutch.

6. A piston cooling device for a multicylinder engine according to claim 5, wherein:

said drive gear is disposed on one crank web of a plurality of crank webs of the crankshaft positioned at an axial end of the crankshaft, and one of the oil jets is mounted in one of the plurality of the journal walls which is disposed outwardly of said drive gear, the one of the oil jets having an oil ejection axis displaced from said drive gear.

7. A piston cooling device for a multicylinder engine according to claim 5, wherein:

at least one crank web of a plurality of crank webs of the crankshaft is shaped to traverse an oil ejection axis of one of the oil jets corresponding to said at least one crank web when the piston, corresponding to said at least one crank web, is positioned in a predetermined range near the bottom dead center, and to keep away from said oil ejection axis when the piston corresponding to said at least one crank web is positioned out of said predetermined range.

8. A piston cooling device for a multicylinder engine according to claim 1, wherein:

at least one crank web of a plurality of crank webs of the crankshaft is shaped to traverse an oil ejection axis of one of the oil jets corresponding to said at least one crank web when a piston, corresponding to said at least one crank web, is positioned in a predetermined range near the bottom dead center, and to keep away from said oil ejection axis when the piston corresponding to said at least one crank web is positioned out of said predetermined range.

9. A piston cooling device for a multicylinder engine, comprising:

a crankshaft rotatably supported by a plurality of journal walls disposed on both sides of a plurality of cylinder bores arrayed in the axial direction of the crankshaft;

an oil jet mounted in a first journal wall for ejecting oil toward a piston disposed in one of the plurality of cylinder bores; and an oil passage for guiding oil to a cylinder head defined in a second journal wall, which is positioned between a pair of adjacent cylinder bores, wherein said second journal wall does not include an oil jet.

10. A piston cooling device for a multicylinder engine according to claim 9, wherein:

the second journal wall in which said oil passage is defined is integrally joined to a partition wall disposed between said crankshaft and a transmission shaft which serves as part of a transmission and extends parallel to the crankshaft, and the transmission shaft is rotatably supported by a support wall integrally joined to said partition wall at a position adjacent to the second journal wall in which said oil passage is defined.

11. A piston cooling device for a multicylinder engine according to claim 10, wherein at least one crank web of a plurality of crank webs of the crankshaft is shaped to traverse an oil ejection axis of an oil jet corresponding to said at least one crank web when a piston, corresponding to said at least one crank web, is positioned in a predetermined range near the bottom dead center, and to keep away from said oil ejection axis when the piston corresponding to said at least one crank web is positioned out of said predetermined range.

12. A piston cooling device for a multicylinder engine according to claim 10, wherein the oil passage is positioned vertically within the second journal wall and does not open at an outer surface of the second journal wall, thus maintaining the rigidity of the second journal wall and the partition wall.

13. A piston cooling device for a multicylinder engine according to claim 10, further comprising:

a clutch mounted on one end of the transmission shaft which extends through said support wall; and a drive gear disposed on said crankshaft held in mesh with a driven gear relatively rotatably mounted on said transmission shaft for inputting power to the clutch.

14. A piston cooling device for a multicylinder engine according to claim 13, wherein:

said drive gear is disposed on one crank web of a plurality of crank webs of the crankshaft positioned at an axial end of the crankshaft; and another oil jet is mounted in one of the plurality of journal walls which is disposed outwardly of said drive gear, the another oil jet having an oil ejection axis displaced from said drive gear.

15. A piston cooling device for a multicylinder engine according to claim 13, wherein at least one crank web of a plurality of crank webs of the crankshaft is shaped to traverse an oil ejection axis of an oil jet corresponding to said at least one crank web when a piston, corresponding to said at least one crank web, is positioned in a predetermined range near the bottom dead center, and to keep away from said oil ejection axis when the piston corresponding to said at least one crank web is positioned out of said predetermined range.

16. A piston cooling device for a multicylinder engine according to claim 9, wherein at least one crank web of a plurality of crank webs of the crankshaft is shaped to traverse an oil ejection axis of an oil jet corresponding to said at least one crank web when the piston, corresponding to said at least one crank web, is positioned in a predetermined range near the bottom dead center, and to keep away from said oil ejection axis when the piston corresponding to said at least one crank web is positioned out of said predetermined range.

17. A piston cooling device for a multicylinder engine, comprising:

a crankshaft;

a plurality of journal walls for supporting the crankshaft disposed on both sides of a plurality of cylinder bores arrayed in the axial direction of the crankshaft;

oil jets mounted in each of the plurality of the journal walls except one journal wall positioned between one pair of the plurality of cylinder bores, each of the oil jets for ejecting oil toward a piston slidably disposed in each of the plurality of cylinder bores; and an oil passage defined in the one journal wall not having one of the oil jets, the oil passage for guiding oil to a cylinder head, wherein the one journal wall in which said oil passage is defined is integrally joined to a partition wall disposed between said crankshaft and a transmission shaft which serves as part of a transmission and extends parallel to the crankshaft.

18. A piston cooling device for a multicylinder engine according to claim 17, wherein at least one crank web of the plurality of crank webs of the crankshaft is shaped to traverse an oil ejection axis of one of the oil jets corresponding to said at least one crank web when the piston, corresponding to said at least one crank web, is positioned in a predetermined range near the bottom dead center, and to keep away from said oil ejection axis when the piston corresponding to said at least one crank web is positioned out of said predetermined range.

19. A piston cooling device for a multicylinder engine according to claim 17, wherein the oil passage is positioned vertically and does not open at an outer surface of the one journal wall within which it is define, thus maintaining the rigidity of the one journal wall and the partition wall.

* * * * *